US009625203B2

(12) United States Patent
Kuehl

(10) Patent No.: US 9,625,203 B2
(45) **Date of Patent: *Apr. 18, 2017**

(54) MOISTURE CONTROL SYSTEM FOR AN APPLIANCE AND METHOD FOR CONTROLLING MOISTURE WITHIN AN APPLIANCE

(71) Applicant: Whirlpool Corporation, Benton Harbor, MI (US)

(72) Inventor: Steven J. Kuehl, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 29 days.

This patent is subject to a terminal disclaimer.

(21) Appl. No.: 14/686,963

(22) Filed: Apr. 15, 2015

(65) Prior Publication Data

US 2015/0219384 A1 Aug. 6, 2015

Related U.S. Application Data

(63) Continuation of application No. 13/836,206, filed on Mar. 15, 2013, now Pat. No. 9,052,133.

(51) Int. Cl.

| | |
|---|---|
| ***F25D 17/06*** | (2006.01) |
| ***F25D 17/08*** | (2006.01) |
| ***F25D 17/04*** | (2006.01) |

(52) U.S. Cl.

CPC ..... *F25D 17/065* (2013.01); *F25D 17/042* (2013.01); *F25D 17/06* (2013.01);

(Continued)

(58) Field of Classification Search

CPC ..... F25D 17/06; F25D 17/067; F25D 17/08; F25D 17/042; F25D 17/065;

(Continued)

(56) References Cited

U.S. PATENT DOCUMENTS

| | | | | |
|---|---|---|---|---|
| 2,689,110 | A | 9/1954 | Strickland | |
| 3,421,338 | A * | 1/1969 | Gidseg | F25D 17/06 62/155 |

(Continued)

FOREIGN PATENT DOCUMENTS

| | | |
|---|---|---|
| JP | 2008309427 | 12/2008 |

*Primary Examiner* — Mohammad M Ali

(57) ABSTRACT

A moisture control system includes a cabinet having a mullion defining first and second compartments and openings within the mullion to provide selective communication between the compartments. An evaporator is disposed in the first compartment. A cooling bank is disposed in the second compartment in selective thermal communication with the evaporator, and includes cooling and condensing portions separated by a dividing member, and a fluid collector disposed proximate the condensing portion. A first cooling fan is disposed proximate the evaporator and configured to direct air across the evaporator and through the first compartment. A second cooling fan is disposed proximate the cooling bank and operable between an evaporator position in fluid communication with the evaporator and the cooling bank, and a bank position in fluid communication with the cooling bank. A panel assembly is disposed proximate the plurality of openings and operable between a plurality of positions.

20 Claims, 6 Drawing Sheets

(52) U.S. Cl.
CPC ..... *F25D 17/067* (2013.01); *F25D 17/08* (2013.01); *F25D 17/045* (2013.01); *F25D 2317/04131* (2013.01); *F25D 2317/0666* (2013.01); *F25D 2317/0682* (2013.01); *F25D 2400/06* (2013.01)

(58) Field of Classification Search
CPC ..... F25D 2400/06; F25D 2317/04131; F25D 2317/0666; F25D 2317/0682; F25D 17/045
USPC ..... 62/91, 408, 419, 93
See application file for complete search history.

(56) References Cited

U.S. PATENT DOCUMENTS 4,075,866 A 2/1978 Williamitis
4,326,390 A 4/1982 Brooks
4,638,644 A * 1/1987 Gidseg ..... F25D 17/065 62/329
4,722,200 A 2/1988 Frohbieter
5,187,949 A 2/1993 Jung-Il et al.
5,355,686 A * 10/1994 Weiss ..... F25D 17/065 62/158
6,266,966 B1 7/2001 Fernandez et al.
6,327,871 B1 12/2001 Rafalovich
6,564,566 B2 * 5/2003 Kim ..... F25D 17/065 62/225
6,725,680 B1 4/2004 Schenk et al.
7,263,856 B2 * 9/2007 Choi ..... F25D 17/045 62/408
7,465,327 B2 12/2008 Jang et al.
7,490,480 B2 * 2/2009 Davis ..... F25D 17/065 62/180
7,726,141 B2 6/2010 Sim et al.
7,958,743 B2 * 6/2011 Lee ..... F25D 23/061 62/407
8,146,379 B2 * 4/2012 Kim ..... B67D 1/0858 62/344
8,490,423 B2 * 7/2013 Joergensen ..... B65D 88/745 62/259.1
8,863,537 B2 10/2014 Junge
9,175,898 B2 * 11/2015 Chae ..... F25D 17/065
2007/0022773 A1 2/2007 Wang et al.
2008/0011013 A1 1/2008 Junge
2009/0019870 A1 * 1/2009 Kuehl ..... F25D 17/045 62/187
2009/0277196 A1 11/2009 Gambiana et al.
2009/0293514 A1 12/2009 Junge
2010/0041327 A1 2/2010 Desler
2010/0154446 A1 6/2010 Oh et al.
2011/0162393 A1 * 7/2011 Kuehl ..... F25D 17/045 62/89
2012/0255321 A1 10/2012 Cho et al.

* cited by examiner

MOISTURE CONTROL SYSTEM FOR AN APPLIANCE AND METHOD FOR CONTROLLING MOISTURE WITHIN AN APPLIANCE

CROSS-REFERENCE TO RELATED APPLICATION

The present application is a continuation of U.S. patent application Ser. No. 13/836,206 filed Mar. 15, 2013, entitled MOISTURE CONTROL SYSTEM FOR AN APPLIANCE AND METHOD FOR CONTROLLING MOISTURE WITHIN AN APPLIANCE, which is incorporated herein by reference in its entirety.

FIELD OF THE INVENTION

The present invention generally relates to control systems for appliances, more specifically, a moisture control system for an appliance.

SUMMARY OF THE INVENTION

In one aspect, a moisture control system for an appliance includes a cabinet having at least four sidewalls defining an appliance opening, a back wall, an interior, a mullion defining first and second compartments of the interior of the cabinet and a plurality of openings defined within the mullion configured to provide selective fluid communication between the first and second compartments. An evaporator is disposed in the first compartment proximate the plurality of openings, wherein the evaporator is in fluid communication with a condenser, a compressor, coolant flow control devices, and a cooling fluid via coolant conduits. A cooling bank is disposed in the second compartment proximate the plurality of openings and configured to be in selective thermal communication with the evaporator, and including a cooling portion, a condensing portion, and a dividing member that physically divides the cooling bank into the cooling portion and the condensing portion, and a fluid collector pan disposed proximate the condensing portion and positioned to receive condensate by gravity from the condensing portion. A first cooling fan is disposed proximate the evaporator and configured to direct air across the evaporator to circulate cooling within the first compartment when air is circulated independently in the first compartment and the second compartment. A second cooling fan is disposed proximate the cooling bank and at least one of the plurality of openings of the mullion, wherein the second cooling fan is operable between an evaporator position, wherein the second cooling fan is in fluid communication with the evaporator and the cooling bank, and a bank position, wherein the second cooling fan is in fluid communication with the cooling bank. A movable panel assembly is disposed proximate the plurality of openings and the first and second cooling fans wherein the movable panel assembly is operable between a plurality of positions.

In another aspect, an appliance includes a moisture control system and a cabinet having at least four sidewalls defining an appliance opening, a back wall, an interior, a mullion defining first and second compartments of the interior of the cabinet and a cooling opening and a return opening defined within the mullion, wherein the cooling and return openings are configured to provide selective fluid communication between the first and second compartments. A housing is disposed proximate an upper portion of the cabinet, wherein the housing includes an evaporator portion disposed proximate the first cabinet, and a cooling bank portion disposed proximate the second compartment. An evaporator is disposed proximate the evaporator portion of the housing proximate the cooling and return openings, wherein the evaporator is in fluid communication with a condenser, a compressor, coolant flow control devices, and a cooling fluid via coolant conduits. A cooling bank is disposed proximate the cooling bank portion of the housing proximate the cooling and return openings and configured to be in selective thermal communication with the evaporator, and including a cooling portion, a condensing portion, and a dividing member that physically divides the cooling bank into the cooling portion and the condensing portion, and a fluid collector pan disposed proximate the condensing portion and positioned to receive condensate by gravity from the condensing portion. A first cooling fan is disposed proximate the evaporator and configured to direct air across the evaporator to circulate cooling within the first compartment when air is circulated independently in the first compartment and the second compartment. A second cooling fan is disposed proximate the cooling bank and selectively disposed proximate the cooling opening of the mullion, wherein the second cooling fan is operable between an evaporator position, wherein the second cooling fan is selectively disposed proximate the cooling opening and in fluid communication with the evaporator and the cooling bank, and a bank position, wherein the second cooling fan is selectively disposed distal from the cooling opening and in fluid communication with the cooling bank. And a movable panel assembly is disposed proximate the cooling and return openings and the first and second cooling fans wherein the movable panel assembly is operable between a plurality of positions.

In yet another aspect, a method for controlling moisture levels within an appliance includes the steps of providing a cabinet having at least four sidewalls defining an appliance opening, a back wall, an interior, a mullion defining first and second compartments of the interior of the cabinet and a plurality of openings defined within the mullion configured to provide selective fluid communication between the first and second compartments. The method also includes the step of providing an evaporator disposed in the first compartment proximate the plurality of openings, wherein the evaporator is in fluid communication with a condenser, a compressor, coolant flow control devices, and a cooling fluid via coolant conduits. The method also includes the step of providing a cooling bank disposed in the second compartment proximate the plurality of openings and configured to be in selective thermal communication with the evaporator, and including a cooling portion, a condensing portion, and a dividing member that physically divides the cooling bank into the cooling portion and the condensing portion, and a fluid collector pan disposed proximate the condensing portion and positioned to receive condensate by gravity from the condensing portion. The step of providing a first cooling fan disposed proximate the evaporator is also included as well as the step of providing a second cooling fan disposed proximate the cooling bank and at least one of the plurality of openings of the mullion. The method also includes the step of moving the second cooling fan between an evaporator position, wherein the second cooling fan is in fluid communication with the evaporator and the cooling bank, and a bank position, wherein the second cooling fan is in fluid communication with the cooling bank. Also included is the step of disposing a movable panel assembly disposed proximate the plurality of openings and the first and second cooling fans wherein the movable panel assembly is operable between a plurality of positions, and selectively operating the movable panel assembly between an open position and a closed position.

These and other features, objects and advantages of the present invention will be further understood and appreciated by those skilled in the art by reference to the following specification, claims, and appended drawings.

DETAILED DESCRIPTION OF THE PREFERRED EMBODIMENT

Figure 1:
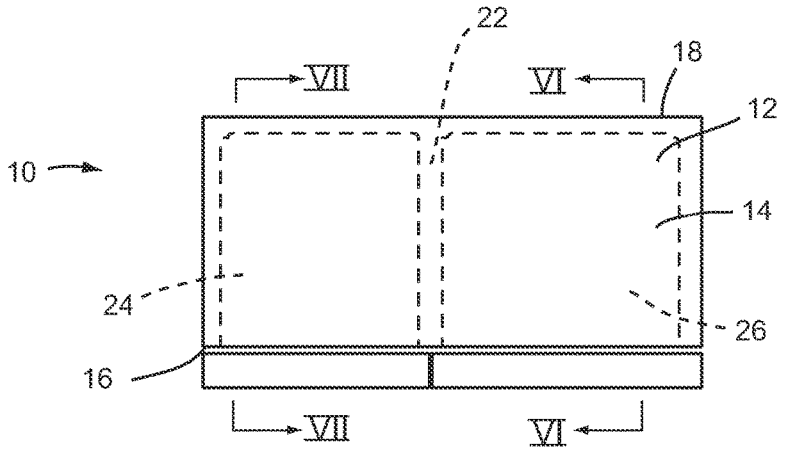
FIG. 1 is a top plan view of one embodiment of the refrigerator using one embodiment of the method.
Figure 2:
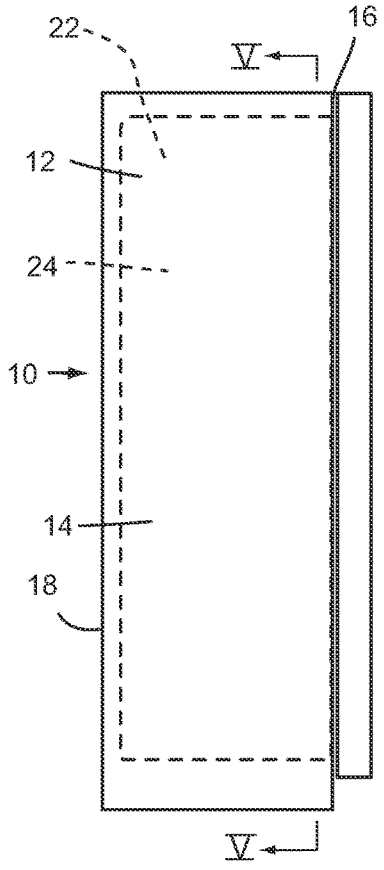
FIG. 2 is a side elevational view of the refrigerator of FIG. 1.
Figure 3:
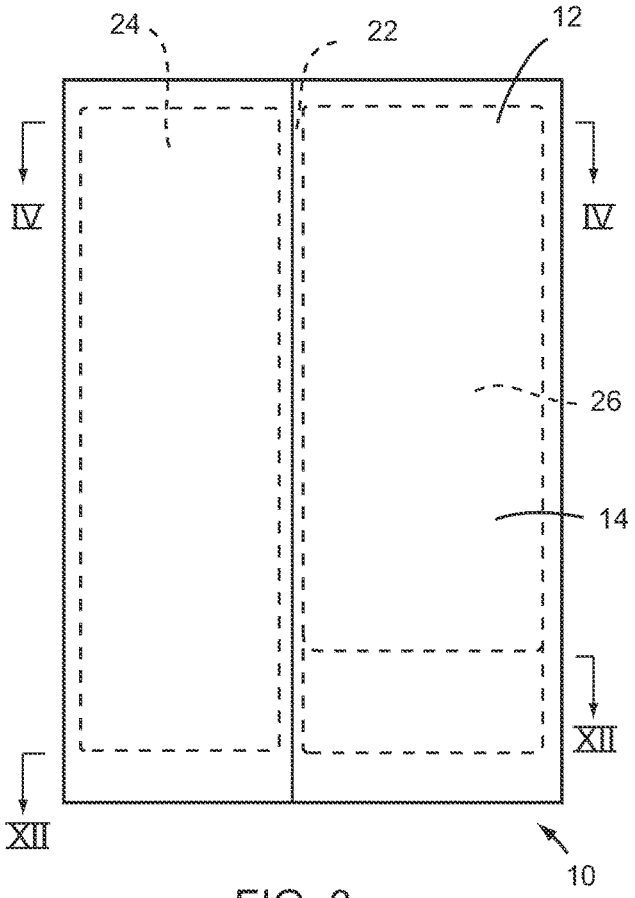
FIG. 3 is a front elevational view of the refrigerator of FIG. 1.
Figure 4:
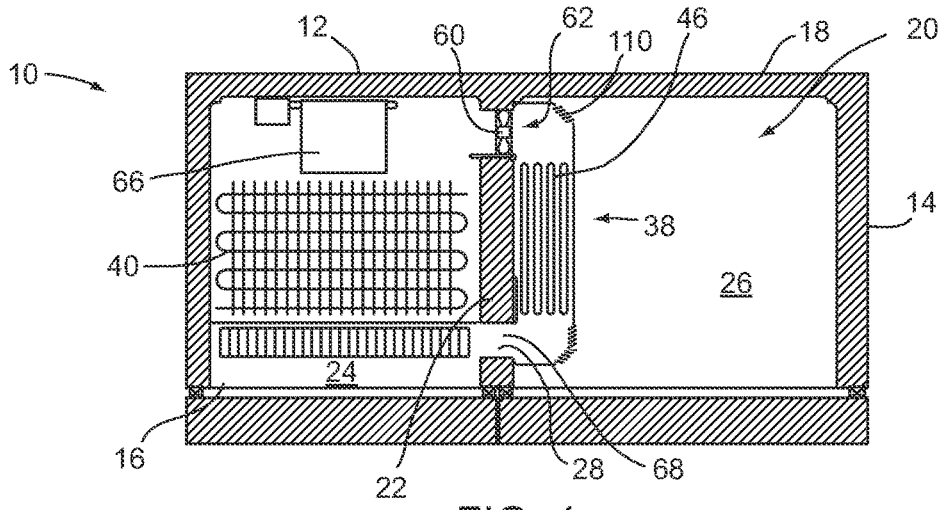
FIG. 4 is a sectional view of the refrigerator of FIG. 3, taken at line IV-IV with the movable panel assembly in the open position.
Figure 5:
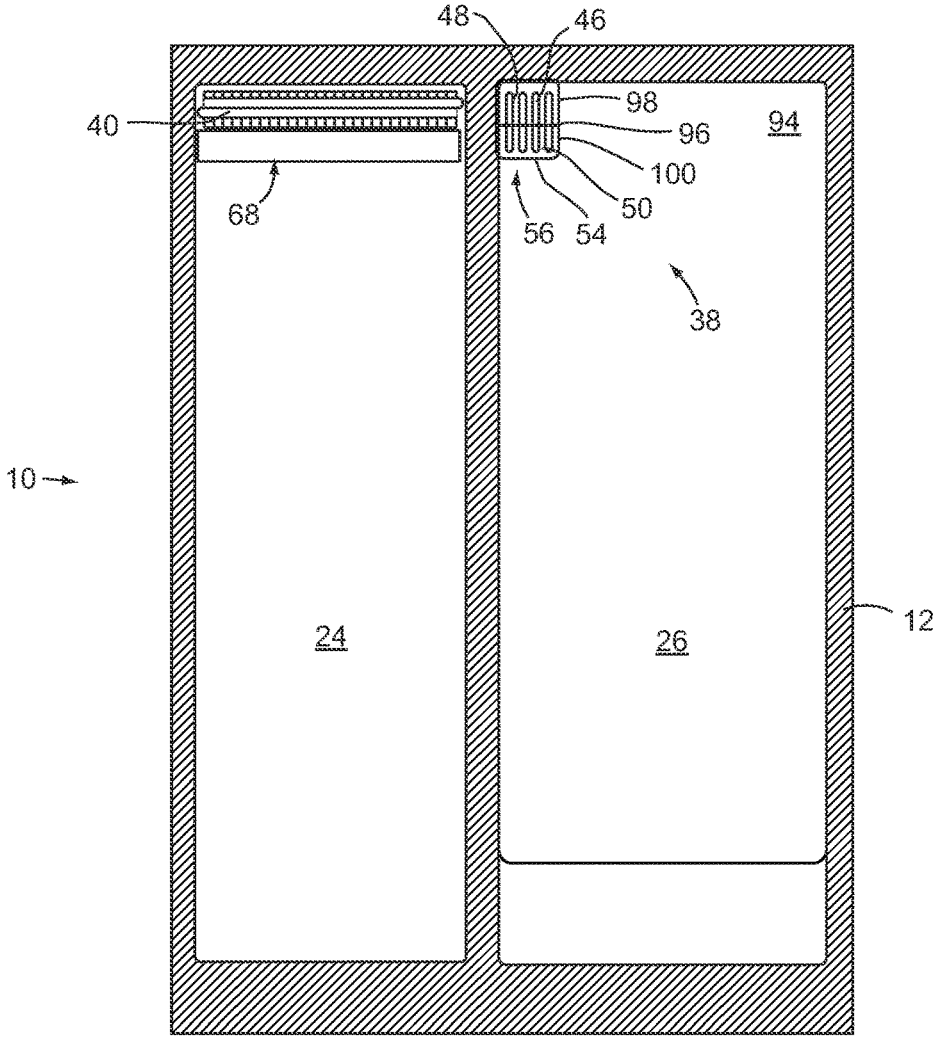
FIG. 5 is a sectional view of the refrigerator of FIG. 2, taken at line V-V with the movable panel assembly in the open position.
Figure 6:
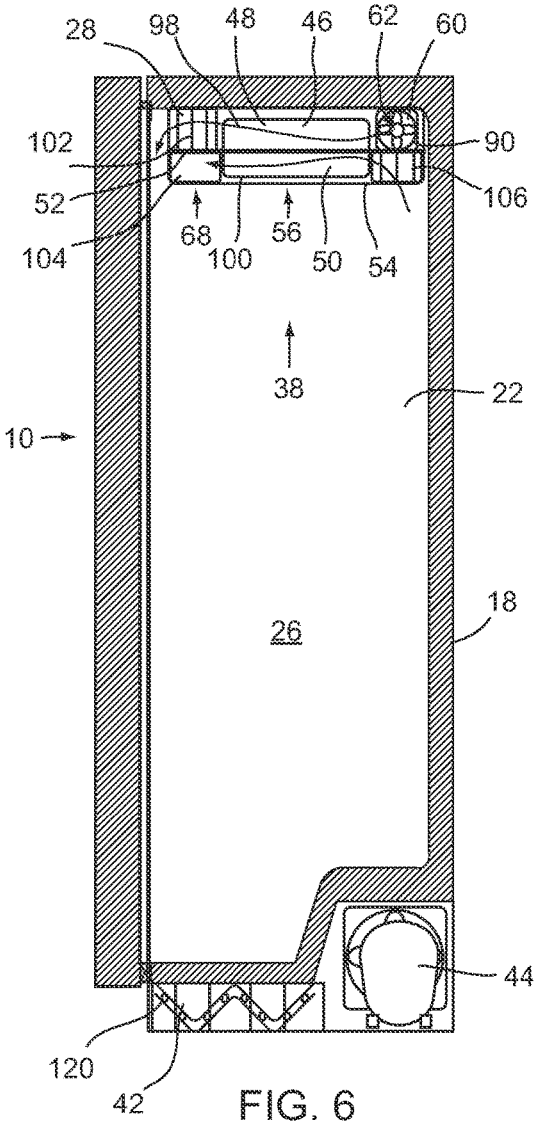
FIG. 6 is a sectional view of the refrigerator of FIG. 1, taken at line VI-VI with the movable panel assembly in the open position.
Figure 7:
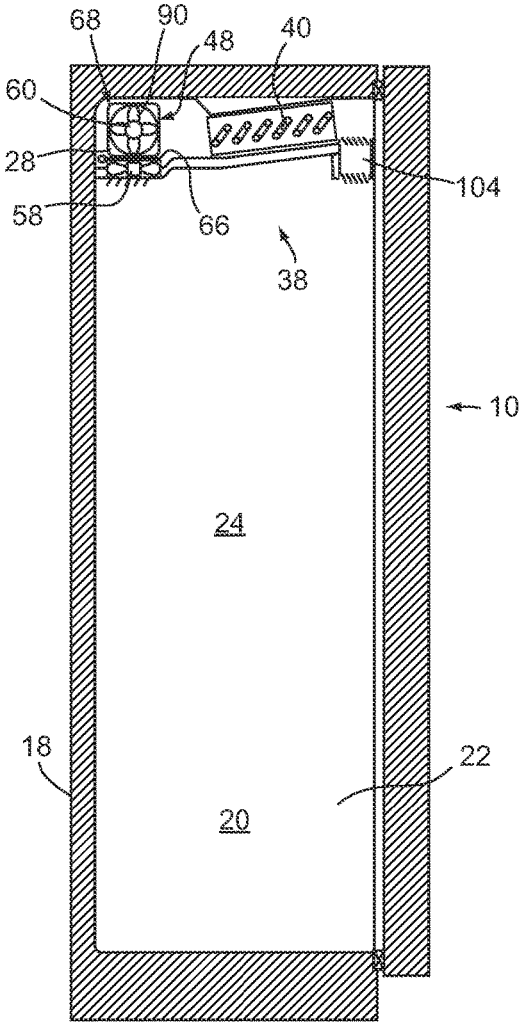
FIG. 7 is a sectional view of the refrigerator of FIG. 1, taken at line VII-VII with the movable panel assembly in the open position.
Figure 8:
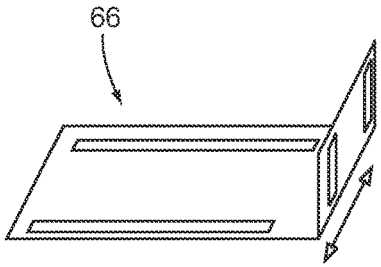
FIG. 8 is a schematic detail view of one embodiment of the movable panel assembly.

For the purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in following specification, are simply exemplary embodiments. Hence, specific dimensions and other physical characteristics relating to the embodiments disclosed herein are not to be construed as limiting, unless expressly stated otherwise.

Referring to the embodiment illustrated in FIGS. 1-4, reference numeral 10 generally refers to an appliance 10 having a cabinet 12 including at least four sidewalls 14 defining an appliance opening 16, a back wall 18, an interior 20, a mullion 22 defining first and second compartments 24, 26 of the interior 20 of the cabinet 12 and a plurality of openings 28 defined within the mullion 22 configured to provide selective fluid communication between the first and second compartments 24, 26.

As illustrated in FIGS. 4-13, a moisture control 38 includes an evaporator 40 is disposed in the first compartment 24 proximate the plurality of openings 28 of the mullion 22, wherein the evaporator 40 is in fluid communication with a condenser 42 (shown in FIG. 6), a compressor 44, coolant flow control devices that include, but are not limited to throttling valves, capillary tubes and orifices, and a cooling fluid via coolant conduits. A cooling bank 46 is disposed in the second compartment 26 proximate the plurality of openings 28 and configured to be in selective thermal communication with the evaporator 40. The cooling bank 46 includes a cooling portion 48, a condensing portion 50, and a dividing member 52 that physically divides the cooling bank 46 into the cooling portion 48 and the condensing portion 50. A fluid collector pan 54 is disposed proximate the condensing portion 50 and positioned to receive condensate 56 by gravity from the condensing portion 50. A first cooling fan 58 is disposed proximate the evaporator 40 and configured to direct air across the evaporator 40 to circulate cooling within the first compartment 24 when the air is circulated independently in the first compartment 24 and the second compartment 26. A second cooling fan 60 is disposed proximate the cooling bank 46 and at least one of the plurality of openings 28 of the mullion 22. The second cooling fan 60 is operable between an evaporator position 62, wherein the second cooling fan 60 is in fluid communication with the evaporator 40 and the cooling bank 46, and a bank position 64, wherein the second cooling fan 60 is in fluid communication with the cooling bank 46 but not the evaporator 40. A movable panel assembly 66 is disposed proximate the plurality of openings 28 in the mullion and the first and second cooling fans. The movable panel assembly 66 is operable between at least open and closed positions 68, 70.

As illustrated in FIGS. 4-7, the movable panel assembly 66 can be configured to be in an open position 68, wherein the movable panel assembly 66 does not block any of the openings disclosed within the mullion 22. In this manner, the evaporator 40 and the cooling bank 46 are in thermal communication, such that cooling can transfer cooling from the evaporator 40 to the cooling bank 46 and the second compartment. When the movable panel assembly 66 is in the open position 68, a portion of the movable panel assembly 66 proximate the first cooling fan 58 is configured to prevent the first cooling fan 58 from directing air across the evaporator 40 and throughout the first compartment 24. In various embodiments, when the movable panel assembly 66 is in the open position 68, the first cooling fan 58 can be switched off.

As illustrated in FIGS. 4-7, the second cooling fan 60 is configured to be proximate one of the openings, a cooling opening 90, within the mullion 22, such that the second cooling fan 60 draws air from the first compartment 24, across the evaporator 40, and into the second compartment. As the second cooling fan 60 brings air from the first compartment 24 into the second compartment, a portion of the air flows toward the cooling bank 46, such that cooling from the evaporator 40 can be transferred from the evaporator 40 into the cooling bank 46. In this manner, cooling from the evaporator 40 is stored within the cooling bank 46 for later use, such as when the movable panel assembly 66 is disposed in the closed position. In various embodiments, the interior temperature of the first compartment 24 is maintained at a lower temperature than the interior temperature of the second compartment. As such, the cooling load for the second compartment 26 is typically less than the cooling load for the first compartment 24. This cooling load difference allows for the use of such a system where the compartment with a higher load has a selectively dedicated evaporator 40, wherein the selectively dedicated evaporator 40 can be used to also provide cooling to a compartment having typically lower cooling loads.

As illustrated in FIGS. 4-7, the cooling bank 46 can be disposed within a housing 92 located proximate a top portion 94 of the cabinet 12. The housing 92 can include a horizontal dividing member 52 that physically divides the cooling bank 46 into an upper cooling portion 48 and a lower condensing portion 50. The horizontal dividing member 52 also physically divides the housing 92 into a cooling channel 98 and a condensing channel 100. The cooling portion 48 of the cooling bank 46 is disposed within the cooling channel 98, where the cooling channel 98 extends from the second cooling fan 60 to a cooling outlet 102. When the movable panel assembly 66 is disposed in the open position 68, the cooling channel 98 works in cooperation with the second cooling fan 60 to direct at least part of the cooled air from the evaporator 40 into the cooling portion 48 of the cooling bank 46 to store cooling within the entire cooling bank 46. The air is then directed out of the cooling channel 98 and into the second compartment 26 to be circulated throughout the second compartment 26 to provide cooling from the evaporator 40 to the second compartment. The condensing portion 50 of the cooling bank 46 is disposed within the condensing channel 100 and extends from a return opening 104 in the mullion 22 to an intake portion 106 of the condensing channel 100. When the movable panel assembly 66 is in the open position 68, the return opening 104 is substantially unobstructed, such that the air being circulated within the second compartment 26 can be returned to the first compartment 24 to be recirculated through the evaporator 40 and back to the cooling bank 46 and the second compartment.

As illustrated in FIGS. 4-7, as cooling is provided to the cooling bank 46, cooling is stored within both the cooling and condensing portions 48, 50 of the cooling bank 46. As cooled air from the evaporator 40 is circulated throughout the second compartment 26, which is maintained at a higher temperature than the first compartment 24, the cooling air flowing in the second compartment 26 warms and increases in moisture content as it provides cooling to the second compartment. This air, typically having increased moisture content, is then directed into the intake portion 106 of the condensing channel 100 and directed toward the condensing portion 50 of the cooling bank 46. The cooling stored in the cooling bank 46, and consequently the condensing portion 50, cools the air passing through the condensing channel 100, thereby decreasing the relative humidity and releasing the condensate 56 into the condensation channel. This condensate 56 is collected by the fluid collector pan 54 and stored for later use, such as when the movable panel assembly 66 is disposed in the closed position.

In various embodiments, the dividing member 52 within the housing 92 can be configured to be a vertical wall that divides the cooling bank 46 into side-by-side cooling and condensing portions 48, 50. Other configurations of the dividing member 52 can be implemented so long as the cooling bank 46 is configured to allow cooling that enters at the cooling portion 48 to be stored throughout the cooling bank 46 in both the cooling and condensing portions. Additionally, this reduces the amount of moisture the evaporator 40 will ultimately remove and thus reduces defrosting needs for the evaporator 40 and allowing for a tighter fin density in the evaporator 40, in turn, allowing for a more compact evaporator 40 and more usable space in the first compartment 24.

In alternate embodiments, the housing 92 can be configured to enclose both the cooling bank 46 and the evaporator 40 within a single housing 92 along with the movable panel assembly 66. In such an embodiment, a single assembly containing the evaporator 40, the cooling bank 46, and the movable panel assembly 66 can be manufactured for installation within the cabinet 12. Alternatively, various embodiments may not include a housing 92, and the evaporator 40, cooling bank 46, and the movable panel assembly 66 are disposed within the cabinet 12. Such an embodiment, can allow the moisture control 38 to be configured in multiple different configurations depending upon the design of the refrigerator.

As illustrated in FIGS. 4-5 and 10-11, the cooling bank 46 is configured into a series of vertical fins disposed parallel to one another. In alternate embodiments, the cooling bank 46 can include fins that are disposed in alternate configurations that include, but are not limited to, horizontal, diagonal, irregular, or other configurations. In other alternate embodiments, the cooling bank 46 may include a series of channels or a perforated material that can allow air to pass around and through the cooling bank 46, such that cooling can be transferred from the evaporator 40 into the cooling bank 46. In still other alternate embodiments, the cooling bank 46 can be made of multiple thermal storage materials that can include, but are not limited to, metals, fluids, fluids that turn solid when storing certain amounts of cooling, ceramic materials, and other thermal storage materials.

As illustrated in FIGS. 4-7 and as discussed above, when the movable panel assembly 66 is in the open position 68, the first cooling fan 58 is turned off. Consequently, the second cooling fan 60 provides for the circulation of air throughout both the first and second compartments 24, 26 when the movable panel assembly 66 is in the open position 68. Because the second cooling fan 60 is the only source of air circulation, the air that is circulated through the second compartment 26 is substantially directed through the condensing channel 100 where the air is cooled and the condensate 56 is removed before returning to the first compartment 24 to be circulated throughout the first compartment 24. The condensate 56 collected by the fluid collector pan 54 is used by the moisture control 38 to selectively increase the relative humidity of the air within the second compartment 26 as necessary to maintain a predetermined relative humidity range of the air within the second compartment. As will be discussed more fully below, when the movable panel assembly 66 is disposed in the closed position 70, the second cooling fan 60 is configured to circulate the air proximate the fluid collector pan 54, such that moisture from the fluid collector pan 54 can be transferred to the air being circulated in the second compartment 26, thereby increasing the relative humidity of the air in the second compartment.

Figure 9:
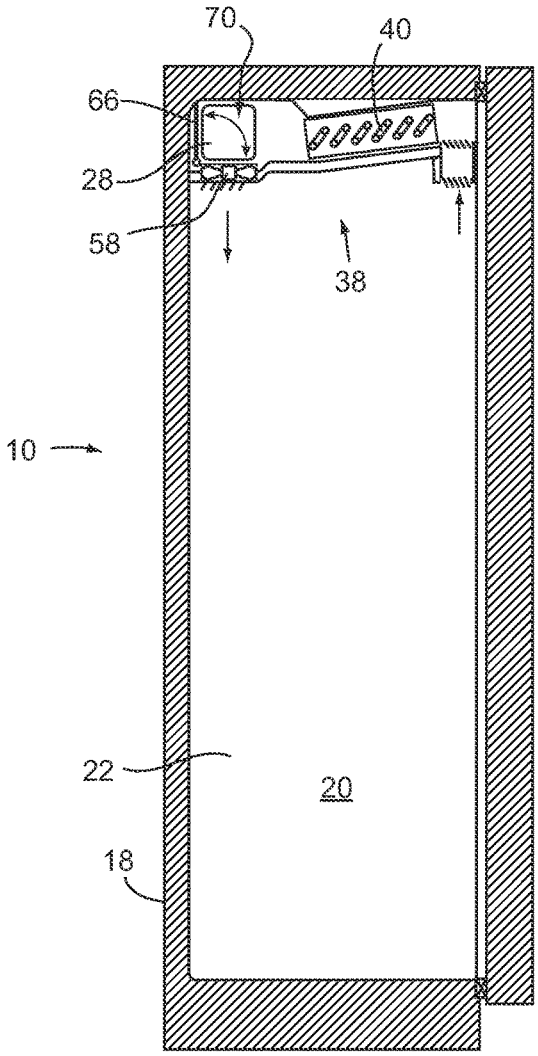
FIG. 9 is a sectional view of the refrigerator of FIG. 7, taken at line VII-VII with the movable panel assembly in the closed position.
Figure 10:
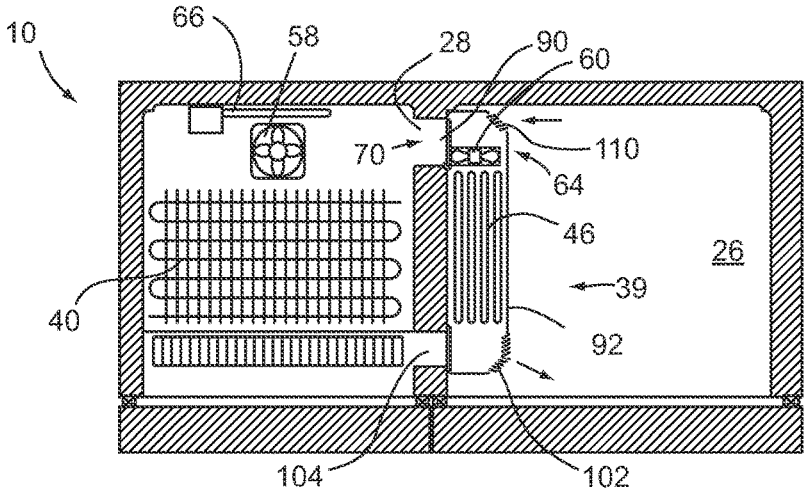
FIG. 10 is a sectional view of the refrigerator of FIG. 4, taken at line IV-IV with the movable panel assembly in the closed position.
Figure 11:
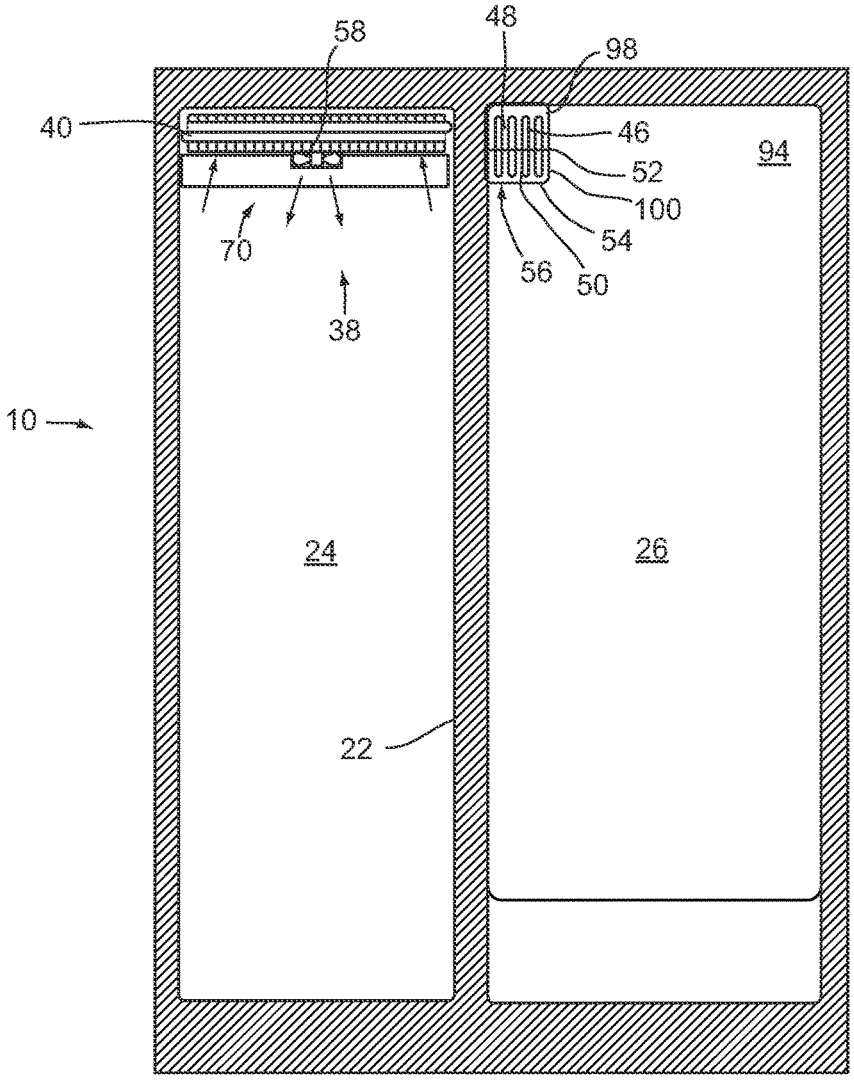
FIG. 11 is a sectional view of the refrigerator of FIG. 5, taken at line V-V with the movable panel assembly in the closed position.

As illustrated in FIGS. 9-11, when the movable panel assembly 66 is in the closed position, air is independently circulated within the first compartment 24 and the second compartment. In the first compartment 24, the portion of the movable panel assembly 66 proximate the first cooling fan 58 is positioned so that the first cooling fan 58 can move air across the evaporator 40 and throughout the first compartment 24. In this manner, cooling from the evaporator 40 is distributed throughout the first compartment 24, thereby decreasing the temperature within the first compartment 24. While in this position, the movable panel assembly 66 covers the plurality of openings 28 within the mullion 22, such that air cannot circulate between the first and second compartments 24, 26. In addition, while the movable panel assembly 66 is in the closed position, the evaporator 40 and the cooling bank 46 are substantially out of thermal communication with one another, wherein cooling does not substantially transfer from the evaporator 40 to the second compartment.

As illustrated in FIGS. 9-11, when the movable panel assembly 66 is disposed within the closed position 70, the second cooling fan 60 is positioned to direct the flow of air toward the cooling bank 46, such that cooling that has been stored within the cooling bank 46 can be distributed throughout the second compartment 26. The second cooling fan 60 is moved to the bank position 64 within the cooling channel 98, such that the second cooling fan 60 moves the air within the second compartment 26 directly into the cooling bank 46 and through the cooling channel 98. The cooling channel 98 can include at least one support opening 110 proximate the second cooling fan, such that air can be drawn into the cooling channel 98 when the movable panel assembly 66 is in the closed position 70 to allow for the independent circulation of air within the second compartment 26. As the second cooling fan 60 circulates air throughout the second compartment 26, the air is directed around the fluid collector pan 54, such that the condensate 56 within the fluid collector pan 54 can be transferred into the air being circulated throughout the second compartment 26.

In order to control the relative humidity of the air within the second compartment 26, various sensors can be disposed within the second compartment 26 to measure various data that can include, but is not limited to, moisture content in the air, percentage relative humidity of the air, and other moisture data. The moisture control 38 can include a processor for receiving data from the sensors and responding to the data by altering various set points within the moisture control 38. By way of example, and not limitation, to modify the moisture content within the air of the second compartment 26, the processor can increase or decrease the speed of the second cooling fan 60, thereby increasing or decreasing the circulation velocity of the air within the second compartment 26, such that varying levels of moisture can be transferred from the fluid collector pan 54 to the air within the second compartment 26. In alternate embodiments, an analog control or digital control can be used to monitor the humidity of the air within the second compartment 26 and modify the moisture control 38 to increase or decrease the moisture within the second compartment 26.

As illustrated in FIGS. 4-11, the movable panel assembly 66 can be a plurality of panels that are configured to work cooperatively to define the open and closed positions 68, 70 of the movable panel assembly 66. In such an embodiment, the second cooling fan 60, which is operable between two positions, can be coupled to at least one of the plurality of movable panels, such that the second cooling fan 60 and the movable panel assembly 66 are in operable communication. In other embodiments, the movable panel assembly 66 can be a single member that can be moved in various configurations to define the open and closed positions 68, 70 of the movable panel assembly 66. In still other embodiments, the movable panel assembly 66 can include a series of apertures wherein the movable panel assembly 66 can be moved in certain configurations, such that the apertures can align with the plurality of openings 28 when the movable panel assembly 66 is in the open position 68, and disalign with the plurality of openings 28 in the mullion 22, such that the movable panel assembly 66 defines the closed position.

Figure 12:
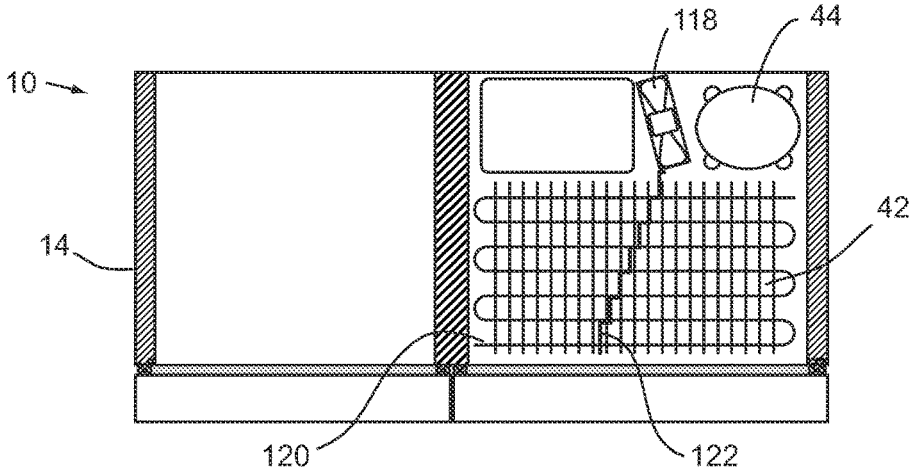
FIG. 12 is a sectional view of the refrigerator of FIG. 3, taken at line XII-XII.

As illustrated in FIG. 12, a condenser fan 118 can be disposed proximate the condenser 42 and compressor 44 of the appliance 10. The condenser fan 118 can be configured to accelerate the flow of air across the compressor 44 and a portion of the condenser 42 to an outlet side 120 where the air is discharged due to the converging flow paths in the left and right halves of the condenser 42 provided by an air divider 122 disposed proximate the condenser. In this manner, the condenser fan 118 can assist the condenser 42 to operate more efficiently in providing cooling to the evaporator 40 within the first compartment 24.

Figure 13:
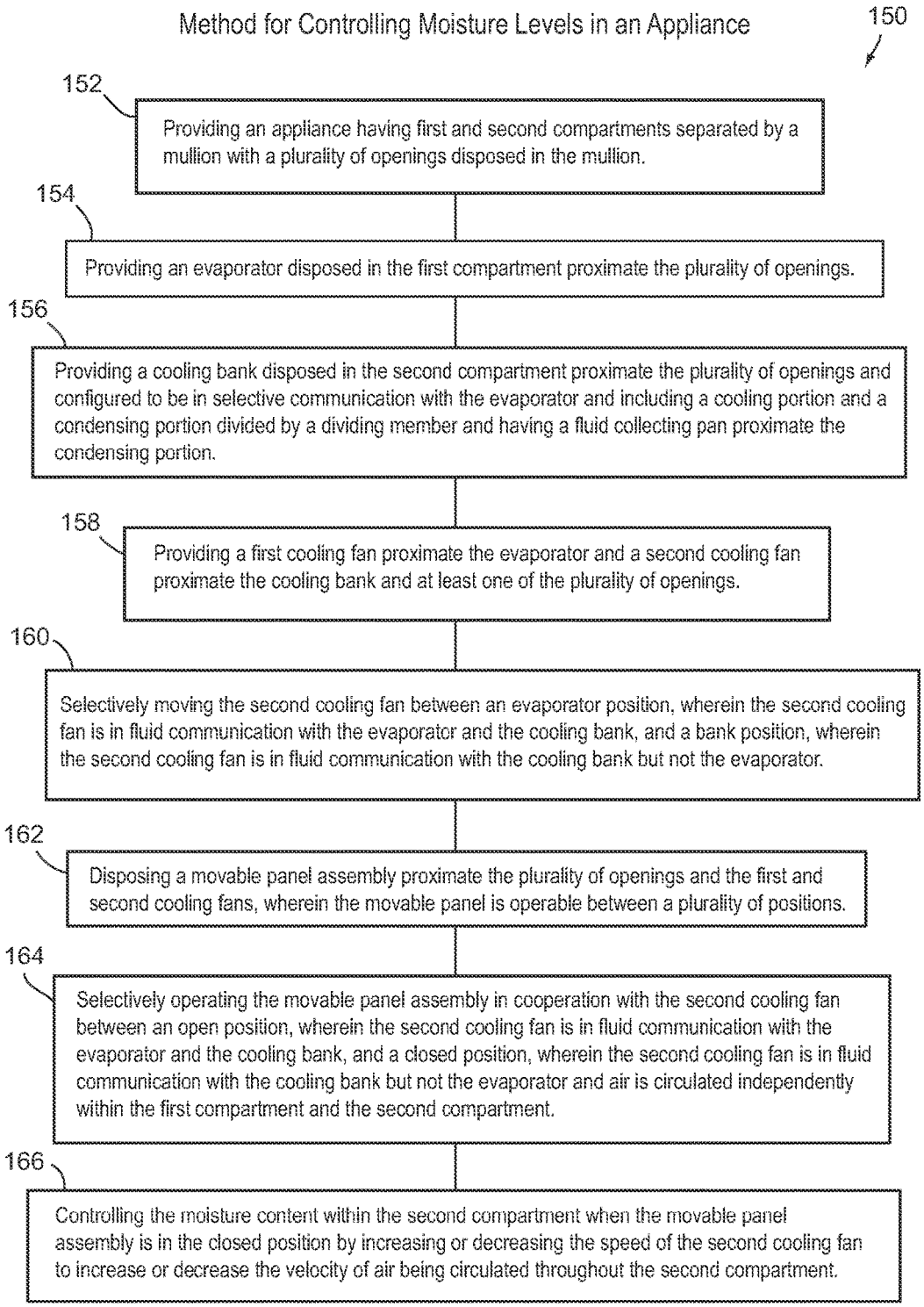
FIG. 13 is a schematic flow chart diagram of one embodiment of a method for controlling moisture levels within an appliance.

Another aspect of the moisture control 38, as illustrated in FIG. 13, includes a method 150 for controlling moisture levels within the appliance 10. A first step 152 of the method 150 includes providing the appliance having at least four sidewalls 14 defining an appliance opening 16, a back wall 18, an interior 20, a mullion 22 defining first and second compartments 24, 26 of the cabinet 12, and a plurality of openings 28 defined within the mullion 22 configured to provide selective communication between the first and second compartments 24, 26.

Another step 154 in the method 150 is providing an evaporator 40 disposed in the first compartment 24 proximate the plurality of openings 28, wherein the evaporator 40 is in fluid communication with a condenser 42, a compressor 44, coolant flow control devices, and a cooling fluid via coolant conduits.

Yet another step 156 in the method 150 includes providing a cooling bank 46 disposed in the second compartment 26 proximate the plurality of openings 28 and configured to be in selective thermal communication with the evaporator 40 and including a cooling portion 48, a condensing portion, and a dividing member 52 that physically divides the cooling bank 46 into the cooling portion 48 and the condensing portion, and a fluid collector pan 54 disposed proximate the condensing portion 50 and positioned to receive condensate 56 by gravity from the condensing portion.

Another step 158 in the method 150 includes providing a first cooling fan 58 disposed proximate the evaporator 40 and providing a second cooling fan 60 disposed proximate the cooling bank 46 and at least one of the plurality of openings 28 of the mullion 22.

The method 150 also includes the step 160 of selectively moving the second cooling fan 60 between an evaporator position 62, wherein the second cooling fan 60 is in fluid communication with the evaporator 40 and the cooling bank 46, and a bank position 64, wherein the second cooling fan 60 is in fluid communication with the cooling bank 46 but not the evaporator 40.

Another step 162 in the method 150 includes disposing a movable panel assembly 66 proximate the plurality of openings 28 and the first and second cooling fans 58, 60, wherein the movable panel assembly 66 is operable between a plurality of positions.

Yet another step 164 in the method 150 includes selectively operating the movable panel assembly 66 in cooperation with the second cooling fan 60 between an open position 68 and a closed position 70.

The method 150 also includes the step 166 of controlling the moisture content within the second compartment 26 when the movable panel assembly 66 is in the closed position 70 by increasing or decreasing the speed of the second cooling fan 60 to increase the velocity of the air being circulated throughout the second compartment 26.

It will be understood by one having ordinary skill in the art that construction of the described net heat load compensation control and other components is not limited to any specific material. Other exemplary embodiments of the invention disclosed herein may be formed from a wide variety of materials, unless described otherwise herein.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A moisture control system for an appliance comprising:

a cabinet having a mullion defining first and second compartments of an interior of the cabinet and at least one opening defined within the mullion configured to provide selective fluid communication between the first and second compartments;

an evaporator disposed in the first compartment proximate the at least one opening, wherein the evaporator is in thermal communication with a refrigeration system;

a cooling bank disposed in the second compartment proximate the at least one opening and configured to be in selective thermal communication with the evaporator;

a first cooling fan disposed proximate the evaporator and configured to direct air across the evaporator to circulate chilled air within the first compartment when air is selectively and independently circulated in each of the first and second compartments; and a second cooling fan disposed proximate the cooling bank and the at least one opening of the mullion, wherein the second cooling fan is operable between a first state and a second state, wherein the second cooling fan is in fluid communication with the evaporator and the cooling bank in the first state, and wherein the second cooling fan is in fluid communication with the cooling bank in the second state.

2. The moisture control system of claim 1, wherein the second cooling fan is configured to direct air through a cooling portion of the cooling bank when air is circulated independently within the first compartment and the second compartment, and wherein the second cooling fan is further configured to direct air proximate a fluid collector pan disposed proximate a condensing portion of the cooling bank, wherein moisture is transferred to the air independently circulated within the second compartment.

3. The moisture control system of claim 1, wherein the cooling bank includes a plurality of cooling fins, and wherein a dividing member of the cooling bank divides the plurality of cooling fins into a cooling portion and a condensing portion.

4. The moisture control system of claim 1, wherein the at least one opening includes a cooling opening, and wherein a movable panel assembly is disposed proximate the cooling opening and the first and second cooling fans, wherein the movable panel assembly is operable between at least two positions to further define the first and second states, and wherein the first state is partially defined by the movable panel assembly disposed in an open position, wherein the second cooling fan moves air across the evaporator from the second compartment through the cooling opening and into the second compartment, wherein cooling from the evaporator is at least partially transferred from the evaporator to the cooling bank, and wherein the movable panel assembly is operable between the open position and a closed position, wherein the closed position at least partially defines the second state.

5. The moisture control system of claim 1, wherein the evaporator and the cooling bank are disposed within a housing proximate an upper portion of the cabinet, wherein a cooling portion of the cooling bank is disposed within a cooling channel extending from the second cooling fan to a cooling outlet, wherein air is circulated through the cooling channel and through the cooling portion when air is selectively and independently circulated in the first and second compartments.

6. The moisture control system of claim 4, wherein the at least one opening includes a return opening disposed proximate a condensing portion of the cooling bank, wherein the condensing portion is disposed within a condensate channel extending from the return opening to a condensate intake, wherein air is circulated from the second compartment through the condensate intake, across the condensing portion and through the return opening into the first compartment when the movable panel assembly is disposed in the open position, and wherein air circulated through the condensing portion when the movable panel assembly is in the open position is at least partially cooled and at least partially dehumidified.

7. The moisture control system of claim 4, wherein the movable panel assembly includes a plurality of operable panels including an evaporator panel disposed proximate the evaporator, a cooling panel disposed proximate the second cooling fan, and a return panel disposed proximate the at least one opening wherein the plurality of operable panels are in operable communication to at least partially define the first and second states.

8. The moisture control system of claim 7, wherein the cooling panel is disposed proximate the second cooling fan and in operable communication with the second cooling fan, wherein the open position of the cooling panel defines an evaporator position of the second cooling fan, and the closed position of the cooling panel defines a bank position of the second cooling fan.

9. A moisture control system for an appliance, the moisture control system comprising:

a housing configured to be disposed within an appliance, wherein the housing includes an evaporator portion, and a cooling bank portion and a mullion wall separating the evaporator portion from the cooling bank portion, the mullion wall including at least one opening;

an evaporator disposed proximate the evaporator portion of the housing proximate the at least one opening;

a cooling bank disposed proximate the cooling bank portion of the housing proximate the at least one opening and configured to be in selective thermal communication with the evaporator;

a first cooling fan disposed proximate the evaporator and configured to direct air across the evaporator to circulate cooling within only a first location when the at least one opening is in a closed position;

a second cooling fan disposed proximate the cooling bank, wherein the second cooling fan is operable between a first state and a second state, wherein the first state is defined by the second cooling fan selectively disposed proximate the at least one opening and in fluid communication with the evaporator and the cooling bank, and wherein the second state is defined by the second cooling fan selectively disposed distal from the at least one opening and in fluid communication with the cooling bank; and a movable panel assembly disposed within the housing proximate the at least one opening and the first and second cooling fans wherein the movable panel assembly is operable relative to the at least one opening between at least two positions to further define the first and second states.

10. The moisture control system of claim 9, wherein the cooling bank is divided into a cooling portion and a condensing portion, and wherein the second cooling fan is configured to direct air through the cooling portion.

11. The moisture control system of claim 10, wherein the cooling bank further includes a plurality of cooling fins, wherein the cooling portion is disposed above the condensing portion.

12. The moisture control system of claim 11, wherein the evaporator and the cooling bank are configured to be in thermal communication when the movable panel assembly is disposed in an open position, and wherein the second cooling fan is disposed in the first state to draw air across the evaporator through the at least one opening in the mullion wall, wherein cooling from the evaporator is at least partially transferred from the evaporator to the cooling bank.

13. The moisture control system of claim 12, wherein the cooling portion of the cooling bank is disposed within a cooling channel of the housing extending from the second cooling fan to a cooling outlet, wherein air is circulated through the cooling channel and through the cooling portion when the second cooling fan is in the second state.

14. The moisture control system of claim 13, wherein the condensing portion is disposed within a condensate channel of the housing extending from a return opening of the at least one opening to a condensate intake, wherein air is circulated through the condensate intake, across the condensing portion and through the return opening when the movable panel assembly is disposed in the open position, and wherein air circulated through the condensing portion when the movable panel assembly is in the open position is at least partially cooled and at least partially dehumidified, wherein condensate is gravity fed into a fluid collector pan.

15. The moisture control system of claim 9, wherein the movable panel assembly includes a plurality of operable panels including an evaporator panel disposed proximate the evaporator, a cooling panel disposed proximate the second cooling fan, and a return panel disposed proximate the at least one opening, wherein the plurality of operable panels are in operable communication to define an open position, wherein the evaporator is in thermal communication with the cooling bank, and a closed position.

16. The moisture control system of claim 10, wherein the cooling bank includes a dividing member that physically divides the cooling bank into the cooling portion and the condensing portion.

17. A method for controlling moisture levels within an appliance comprising steps of:

providing a cabinet having a mullion defining first and second compartments of an interior of the cabinet, and at least one opening defined within the mullion configured to provide selective fluid communication between the first and second compartments;

providing an evaporator disposed in the first compartment proximate the at least one opening, wherein the evaporator is in fluid communication with a coolant fluid;

providing a cooling bank disposed in the second compartment proximate the at least one opening and configured to be in selective thermal communication with the evaporator;

providing a first cooling fan disposed proximate the evaporator;

providing a second cooling fan disposed proximate the cooling bank and the at least one opening;

operating the second cooling fan between a first state, wherein the second cooling fan is in fluid communication with the evaporator and the cooling bank, and a second state, wherein the second cooling fan is in fluid communication with the cooling bank;

disposing a movable panel assembly proximate the at least one opening and the first and second cooling fans wherein the movable panel assembly is operable between a plurality of positions; and selectively operating the movable panel assembly between an open position and a closed position.

18. The method of claim 17, further comprising the step of:

selectively operating the first cooling fan to circulate air within the first compartment when the movable panel assembly is disposed in the closed position, wherein the second cooling fan is disposed in the second state and air is circulated independently within the first compartment and the second compartment.

19. The method of claim 18, further comprising the step of:

selectively disposing the movable panel assembly to the open position wherein the evaporator and the cooling bank are in thermal communication and air is substantially circulated through the first and second compartments collectively, and wherein cooling from the evaporator is selectively transferred from the evaporator to the cooling bank.

20. The method of claim 19, further comprising steps of:

providing a fluid collector proximate the cooling bank and configured to receive moisture from the cooling bank;

selectively transferring moisture from the fluid collector to the air being independently circulated through the second compartment, wherein the second cooling fan is configured to direct air proximate the fluid collector, and wherein the second cooling fan includes a predetermined moisture-delivery speed.

* * * * *